US007628889B2

(12) United States Patent
Scobie

(10) Patent No.: US 7,628,889 B2
(45) Date of Patent: Dec. 8, 2009

(54) LIGNOCELLULOSE FIBER-RESIN COMPOSITE MATERIAL

(75) Inventor: Michael A. N. Scobie, Tee Lake (CA)

(73) Assignee: Tembec Industries Inc., Montreal, Quebec ( * ) Notice: Subject to any disclaimer, the term of this patent is extended or adjusted under 35 U.S.C. 154(b) by 0 days.

(21) Appl. No.: 12/135,398

(22) Filed: Jun. 9, 2008

(65) Prior Publication Data

US 2009/0139674 A1 Jun. 4, 2009

Related U.S. Application Data

(63) Continuation of application No. 10/666,266, filed on Sep. 22, 2003, now Pat. No. 7,396,438.

(51) Int. Cl.
*D21F 13/00* (2006.01)

(52) U.S. Cl. ..... 162/218; 162/222; 162/147; 264/86; 264/122; 428/153

(58) Field of Classification Search ..... 162/218, 162/222, 147; 264/86, 122, 128; 428/153, 428/92

See application file for complete search history.

(56) References Cited

U.S. PATENT DOCUMENTS

| | | | |
|---|---|---|---|
| 4,753,713 | A | 6/1988 | Gunderson |
| 5,039,465 | A | 8/1991 | Freeman |
| 5,213,885 | A | 5/1993 | Zogg |
| 6,068,804 | A | 5/2000 | Betzner |
| 6,086,720 | A | 7/2000 | Bodary |
| 6,099,906 | A | 8/2000 | Palmer |
| 6,245,385 | B1 | 6/2001 | Takahashi |
| 6,403,000 | B1 | 6/2002 | Symons |
| 6,869,659 | B2 | 3/2005 | Shepard |
| 7,128,023 | B2 | 10/2006 | Otsuji |
| 2003/0125458 | A1 | 7/2003 | Thiele |

FOREIGN PATENT DOCUMENTS

| | | |
|---|---|---|
| EP | 0532445 A1 | 3/1993 |
| JP | 2001353618 | 11/2001 |

OTHER PUBLICATIONS

International Search Report.

*Primary Examiner*—Mark Halpern
(74) *Attorney, Agent, or Firm*—Jeffrey S. Melcher; Manelli Denison & Selter PLLC

(57) ABSTRACT

A method of making a formed, dried lignocellulose fiber material comprising (a) providing an aqueous lignocellulose fiber pulp slurry having an effective consistency; (b) de-watering the slurry to provide a de-watered material at an effective de-watering rate under an effective pressure to prevent or reduce the formation of fissures and voids within the material; (c) drying an effective amount of the de-watered material at an effective temperature and period of time to provide the formed, dried lignocellulose fiber material having a thickness of at least 5 mm. The formed, dried lignocellulose material may be used to make a lignocellulose fiber-resin composite material of use as a cost effective structural member, as a substitute for steel, in, for example, bridges, processing equipment, and the like.

8 Claims, 1 Drawing Sheet

LIGNOCELLULOSE FIBER-RESIN COMPOSITE MATERIAL

This application is a continuation of U.S. application Ser. No. 10/666,266, filed 22 Sep. 2003, now U.S. Pat. No. 7,396,438, the complete disclosure of which is incorporated herein by reference.

FIELD OF THE INVENTION

This invention relates to lignocellulose fiber-resin composite materials, particularly with thermoset resins; dried lignocellulose fiber used in the manufacture of said composite materials and apparatus and processes in the manufacture thereof.

BACKGROUND TO THE INVENTION

Presently, carbon steel is the material of choice for most exterior infrastructure applications because of its superior strength properties and relatively low cost per unit weight. However, frequently, the limitations of steel, which include corrosion and maintenance challenges, excessive weight and high erection costs are being recognized. As an example, in bridge construction it is estimated that within the next 25 years, over 50% of all of the bridges in North America will either require extensive repair or complete replacement due to the lack of sustained infrastructure funding. Most of the major civil engineering and government authorities have expressed their lack of enthusiasm for approaching this problem with traditional steels because of their desire to avoid the same predicament in the future. For this reason, new advanced materials are being sought that can rival the tensile/impact strengths and initial installed cost of steel, while at the same time outperform it in terms of strength to weight, life-span and cost of upkeep.

In other areas, such as in industrial processing equipment markets, where strength to weight is important, replacement of steel with a suitable alternative is desired. For example, large industrial roll cores for pulp and paper dry machines are fabricated from steel. Because of steel's flexibility, a roll made from it must be thick enough to overcome its own dead weight in order to span a certain distance with minimal flex under load. This extreme weight accelerates bearing failure, and results in slow and difficult roll installation and removal. Substitution of the steel with a material having less flex over the same length at a fraction of the weight should provide significant cost advantages in installation and maintenance.

There is, therefore, a need for materials as substitutes for steel in structural environments which provide better strength to weight ratios, easier installation and lower installation and maintenance costs.

SUMMARY OF THE INVENTION

It is an object of the present invention to provide a lignocellulose fiber-resin composite material having better strength to weight ratios than steel, of use as structural members formed therefrom.

It is a further object to provide processes for making said lignocellulose fiber-resin composite material.

It is a yet further object to provide a formed, minimally flawed dried lignocellulose fiber material of use in the manufacture of said lignocellulose fiber-resin composite material.

It is a still yet further object to provide processes for the manufacture of said formed, minimally flawed, dried, lignocellulose fiber material.

We have found that by reducing the degree of fissures, voids and the like, i.e. flaws, in a dried lignocellulose fiber material of a thickness of at least 5 mm, preferably of at least 2 cm, that a useful product can be obtained according to the invention.

Accordingly, the invention provides in one aspect, a method of making a formed, dried lignocellulose fiber material comprising (a) providing an aqueous lignocellulose fiber pulp slurry having an effective consistency;

(b) de-watering said slurry to provide a de-watered material at an effective de-watering rate under an effective pressure to prevent or reduce the formation of fissures and voids within said material;

(c) drying an effective amount of said de-watered material at an effective temperature and period of time to provide said formed, dried lignocellulose fiber material having a thickness of at least 5 mm.

In a preferred aspect the invention provides a method as hereinabove defined of making a formed, minimally flawed dried lignocellulose fiber material, said method comprising (a) providing an aqueous lignocellulose fiber pulp slurry having an effective consistency;

(b) de-watering said slurry to provide a de-watered material at an effective de-watering rate under an effective pressure to prevent or substantially reduce the formation of fissures and voids within said material; and (c) drying said de-watered material at an effective temperature and period of time to provide said minimally flawed, dried, formed fiber material.

By the term "minimally flawed" in this specification means that visual inspection of any exterior or cross-sectioned interior surface of the dried, formed, fiber shape reveals that at least 90% and, preferably, 95% of that surface area is not fissures or voids.

Preferably, the minimally flawed, dried lignocellulose fiber material is essentially, fissure and void free.

The lignocellulose fiber of use in the practise of the invention has an average fiber length of about less than 1.0 cm. In the case of hardwood fibers the preferred average length is selected from about 0.5-1.0 mm, and in the case of softwood fibers, the average fiber length is selected from about 1.0-4.0 mm, and in the case of non-wood fibers. The average fiber length is selected from 0.5-10 mm.

Preferably, the slurry of step (a) has a fiber consistency of between 0.1-10% W/W; and the dewatered material produced by step (b) has a dry bulk density of between 0.1-0.9 g/cm$^3$.

Although still of value, increasing the fiber consistency causes the fibers to clump, and poor formation tends to produce fissures and voids that will ultimately lead to points of weakness in the resultant product.

To distinguish the present invention from lignocellulose fiber material in the form of paper sheets and cardboards of relatively small thickness, the invention is directed to the production and use of dried lignocellulose fiber material of a significant 3-dimensional shape, having a thickness of at least 5 mm and, preferably, minimally flawed. Preferably, the material is such as to have a thickness of at least 2 cm while having a greater length and/or width.

Thus, the present invention in one aspect produces a "minimally flawed" 3-dimensional fiber shape from a pulp/water slurry, by controlling its bulk density. Thus, "minimally flawed" includes the substantial absence of void regions or fissures where two separate fiber planes meet but do not intimately interact and, thus, do not bond. We have found that fissures form when regions of a pulp slurry dewater too quickly and cause the fibers in these areas to fold in on themselves to form discreet boundaries that render the fibers unavailable for adjacent fiber intermingling and bonding. This inevitably causes weakness in the final impregnated material. Void regions can form when areas of low consistency are trapped within the fiber shape and eventually open up upon drying.

The resultant fiber shape may, optionally, be pressure impregnated with a thermoset resin wherein the depth of impregnation is controlled to optimize the strength to weight, while minimizing the amount of resin used and, thus, the cost. After the shape has been impregnated, a final forming stage may be used to ensure the exact dimensions, and that a smooth impermeable surface is formed. The impregnated shape is then cured, for example, in a conventional oven. Overall, this process leads to great flexibility in terms of shape, dimension, strength and cost.

We have discovered that good fiber distribution and formation within the 3-D lignocellulose fiber material is required to produce an efficacious strong product. It is also desired that the randomness of the fiber orientation and inter fiber entanglement be maximized. We believe that the reason that traditional lignocellulose fiber resin composites have suffered from lack of strength is that the resin and fiber have been combined without the structured fiber formation.

The dewatering step under a suitable rate to result in the correct dry bulk density may be carried out by any suitable means, preferably, compression means which exerts a compressive force of about 10-100 psi. Preferably, in one embodiment, the slurry is pumped into a so-called perforated formation trough having fixed perforated side plates, a removable perforated bottom, and a mechanically driven perforated or solid plunger top. As the plunger descends, the slurry dewaters through the perforations until the pulp at the bottom of the trough reaches the desired degree of compression and, thus, dry bulk density preferably of 0.1-0.9 g/cm$^3$. The perforated plating can either be porous metal or have holes. An optimal hole diameter is approximately 1.5 mm and an optimal hole density is around 5 holes per 6 cm$^2$. Objects of any size and shape may be made by judicious selection of trough bottom, side and plunger shapes.

Once the desired pulp density has been reached, the bottom plate is disengaged and the plunger descent is continued until the fiber material supported by the bottom plate is pushed out. The material is then transferred to a support basket and conveyed to a convectional-drying oven operating, at preferably 60-90° C. with a drying time, typically of 4-24 hours depending on the size of the material. The objection of the drying stage is to remove essentially all of the water from the material, to maximize the hydrogen bonding between the lignocellulose fibers and, thus, the material strength. This is important for the subsequent resin impregnation stage. It has been found that if the drying rate is too fast, stresses in the material will occur and cause fissures and, ultimately, unwanted points of failure in the final cured fiber/resin composite material.

In a further aspect, the invention provides a formed, dried lignocellulose fiber material when made by a process as hereinabove defined.

Preferably, the dried lignocellulose fiber material is essentially fissure and void free.

Examples of lignocellulose fibers of use in the practise of the invention may be selected from the group consisting of bleached, unbleached, dried, undried, refined, unrefined kraft, sulfite, mechanical, recycled, virgin wood and non-wood fibers. Examples of non-wood fibers include agricultural waste, cotton linters, bagasse, hemp, jute, grasses and the like.

In a further aspect, the present invention provides a method of making a lignocellulose fiber-resin composite material comprising the steps as hereinabove defined and further comprising the steps of (a) impregnating said dried formed fiber material with a liquid thermoset resin under an effective pressure for an effective period of time to effect impregnation of said resin in said dried formed fiber material at a desired rate and to a desired degree to produce a resin-treated material; and (b) curing said resin in said resin-treated material to produce said composite material.

In the production of the lignocellulose fiber-resin composite material according to the invention, the 3-D minimally flawed lignocellulose fiber material, as hereinabove defined and made, is impregnated under controlled conditions with liquid thermoset resin. Typically, the dried fiber material is placed in an impregnation chamber, which, typically, is filled with a liquid thermoset resin at the desired temperature, of about 5-25° C., to the point where the material will always be submerged, even after the desired degree of impregnation is achieved. The chamber is closed and air under pressure is introduced into the top gas phase in order to pressurize the chamber interior up to the desired level of, say, 20-100 psi. Air pressure and duration of time are the main parameters used to control the rate and desired depth of impregnation of the resin into the formed fiber material.

Depending on the size of the fiber material and shape, a pressure is chosen in order to ensure that the required time, generally, falls within a practical range of about 5-40minutes. If the rate is too fast, the process is, generally, difficult to control; while if too slow, the process efficiency suffers. For a given resin type and fiber density, a particular pressure/temperature/time combination results, generally, in the same impregnation rate. Also, pressure and time appear to have a significant impact on the migration of the different molecular weight materials found within the resin. This is important because the larger molecular weight resin material results in higher strength of and better skin formation on the final formed product.

After the required impregnation time, the pressure is released from the chamber, the excess resin is drained, and the impregnated material is removed. It has been found that once the material is no longer in contact with the resin, the pressure is at zero gauge, impregnation is halted, and a very defined impregnation line is produced and seen within the composite form. Observation of this demarcation line during the practice of the invention provides more evidence of tight control and ultimately more successful prediction of the strength characteristics of the final composite product. It is this clearly defined two mass phase structure within the material that differentiates it from other composite materials.

It has been surprisingly discovered that during resin impregnation, no significant swelling of the dried lignocellulose fiber material occurred. Without being bound by theory, this is likely explained by hydrogen bonding in that once the fiber shape has been produced and polar water has evaporated away, bonding between adjacent lignocellulose fiber hydroxyl groups has occurred. This is believed to be what gives a dried lignocellulose fiber mass its strength characteristics. When the relatively non-polar resin comes in contact with the lignocellulose, there is little incentive for these hydrogen bonds to break down and, as a result, the form holds its shape.

To ensure that the exact dimensions can be attained and that a good impermeable skin is formed, the impregnated material may be, optionally, put through a final forming press. The press configuration may be a die for forms that are in an extrudable shape or a sandwich press for shapes that are non-uniform.

The formed, impregnated material is then, preferably, placed in a curing oven at a temperature, generally of about 50-95° C., for 4-24 hours in order to completely cure the resin. The initial curing temperature must be kept, most preferably, below 100° C. because of the thickness of the formed material being cured, and because water is released from the resin during the curing process. At the beginning of the curing process, the resin at the outer surface is the first to cure and form an impermeable layer. Subsequently, the resin in the interior of the form begins to cure after this outer layer has been formed. If water is trapped within the form and goes beyond 100° C., it will boil, create pressure, and the sealed form will rupture before the moisture has time to escape via natural permeation. The curing temperature can be increased beyond 100° C. later in the cure to maximize polymerization and thus, strength.

Accordingly, in a still further aspect the invention provides a formed, lignocellulose fiber-resin composite material when made by a process as hereinabove defined.

Preferably, the material is essentially fissure and void free.

BRIEF DESCRIPTION OF THE DRAWINGS

In order that the invention may be better understood, preferred embodiments will now be described, by way of example only, with reference to the accompanying drawings, wherein.

DETAILED DESCRIPTION OF PREFERRED EMBODIMENTS

EXAMPLES

Figure 1:
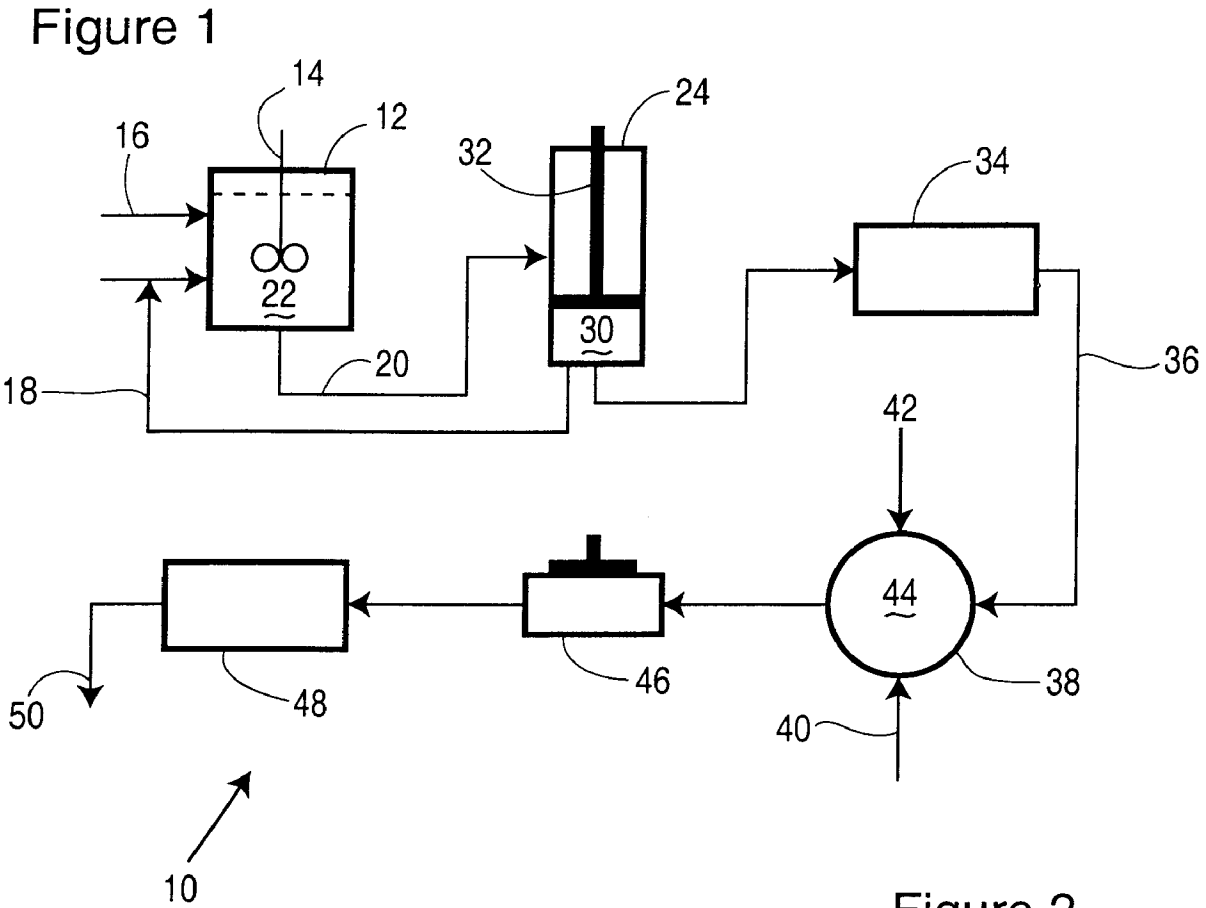
FIG. 1 is a schematic diagram of apparatus and process according to the invention.

With reference to FIG. 1, this shows, generally, as 10 a process and apparatus for carrying out a process of making a formed lignocellulose fiber-resin composite material. System 10 has a slurry mix tank 12, with associated stirrer 14, and having a pulp feed inlet conduit 16, a recycled white water conduit 18, and a slurried pulp outlet conduit 20, for transferring pulp 22 of a desired consistency to a perforated formation trough 24. Trough 24, in this embodiment, has vertical rectangular sides 26, which with steel bottom 28 define the shape of the desired form of de-watered material 30.

Within trough 24 is a piston 32 which is applied at an effective rate to an effective degree of compression to produce de-watered material 30 having, essentially, no or only a few minor flaws. Piston 32 is operated by compression means (not shown).

De-watered material 30 is transferred to a fiber-air drying oven 34, wherein material 30 is dried at an effective temperature for a period of time to provide essentially a minimally flawed dried lignocellulose fiber material 36. Material 36 is transferred to a resin impregnation chamber 38 having a resin inlet 40 and a pressurized air inlet 42.

Material 30 is dried to give material 36 having no more than 5% W/W water content, or, preferably, no more than 3% W/W water.

Figure 2:
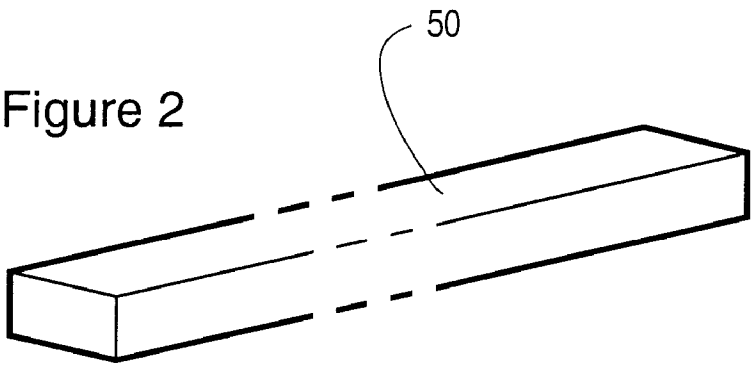
FIG. 2 is a sketch of a formed composite according to the invention.

With reference also to FIG. 2, formed lignocellulose fiber-resin composite material 44 is produced in chamber 38 by resin feed from inlet 40 totally immersing form 38 and impregnating form 38 under air pressure fed in through conduit 42 at a selected pressure of between 20-100 psi for a selected period of time. The major impregnation parameters are (i) the nature of the resins (typically phenol-formaldehyde of desired molecular weights), and pulp fibers, (ii) air pressure, (iii) temperature, typically 20-30° C., and (iv) duration of time, typically 10-60 minutes depending on the degree of impregnation desired. These parameters can be readily determined by simple calibration studies dependent on the desired strength characteristics of the form.

Optimally, additional shaping of 44 can be performed by forming press 46, prior to curing in curing oven 48, to give final composite product 50, having final dimensions of 3 m length, 20 cm width and 5 cm thick, shown as 50 in FIG. 2.

Example 1

As a starting material, 140 grams of bleached paper grade sulfite pulp was mixed with 50° C. water in a British Disintegrator to produce a slurry with a consistency of 2.5%. The slurry was then poured into a perforated formation trough and the trough topped up with water. Without external pressure, there is only minimal water loss. The slurry in the trough was mixed again to ensure good randomization. The plunger was set in place and forced downward by hand to begin the dewatering step. Once the end of the plunger shaft had descended enough, the slurry was compressed under a screw mechanism to attain a dry bulk density of 0.45 g/cm$^3$. The bottom plate was removed and the wet fiber form in the shape of a rectangular brick of length 20 cm, width 10 cm and thickness 5 cm, was pushed out the bottom and placed in an oven at 85° C. for 8 hours to dry.

The dry brick was cut into 6 pieces, four of them were labeled 3A, 3B, 3C, 3D and their weights measured. One at a time, each piece was then placed in a pressure impregnation chamber and submerged in a phenol formaldehyde thermoset resin identified as TXIM 383. The chamber was sealed and pressurized for a designated period of time after which the pressure was released and the piece removed.

The impregnated pieces were then placed in an oven at 90° C. for 20 hours in order to ensure complete curing. Each piece was weighed again and then cross-sectioned to visually inspect the impregnation depth and pattern differences between the cut sides and the original uncut sides. Table 1 shows the results.

TABLE 1

| Sample ID | Pressure (psi) | Time (min) | Initial Air Dry Pulp Wt (g). | Final Bone Dry Composite Wt (g) | Visual Inspection |
|---|---|---|---|---|---|
| 3A | 30 | 2.0 | 22.2 | 40.5 | Uncut side - 3 mm depth<br>cut side - 6 mm depth |
| 3B | 30 | 3.0 | 19.9 | 42.3 | Uncut side - 5 mm depth<br>cut side - 8 mm depth |
| 3C | 30 | 4.0 | 20.2 | 42.7 | Uncut side - 5 mm depth<br>cut side - 9 mm depth |
| 3D | 15 | 3.0 | 23.4 | 35.0 | Uncut side - 2 mm depth<br>cut side - 8 mm depth |

A summary of the results is as follows:

This series demonstrated the feasibility of tightly controlling impregnation depth based on pressure and time. Lowering the pressure definitely resulted in a thinner impregnation region, but the density did not seem to be affected.

Average impregnation rate for 30 psi was: uncut side—1.5 mm/min, cut side—2.6 mm/min.

Average impregnation rate for 15 psi was: uncut side—0.7 mm/min, cut side—2.7 mm/min.

Example 2

Using the same preparation as in Example 1, two fiber bricks of differing densities (series 2 fiber density: 0.53 m/cm$^3$, series 1 fiber density: 0.46 g/cm$^3$) were produced, segmented, impregnated with resin TXIM 383 and the impregnated pieces cured. The difference with these sets was that higher pressures were attempted. Table 2 lists the results.

TABLE 2

| Sample ID | Pressure (psi) | Time (min) | Initial Air Dry Pulp Wt (g) | Final Bone Dry Composite Wt (g) | Visual Inspection |
|---|---|---|---|---|---|
| 2C | 90-100 | 2.5 | 20.7 | 45.2 | Slight non-impregnated core |
| 2A | 90-100 | 5.0 | 22.6 | 49.0 | Fully impregnated |
| 2B | 110 | 7.5 | 20.4 | 51.5 | Fully impregnated |
| 2D | 90-100 | 10.0 | 23.8 | 49.3 | Fully impregnated |
| 1A | 100 | 0.5 | 22.9 | 43.3 | Large non-impregnated core |
| 1B | 100 | 1.0 | 21.2 | 48.1 | Slight non-impregnated core |
| 1C | 100 | 1.5 | 19.6 | 50.8 | Fully impregnated |
| 1D | 100 | 2.0 | 21.9 | 51.1 | Fully impregnated |

A summary of the observations is as follows:

During impregnation, there appeared to be minimal fiber swelling.

All of series 2 were almost completely impregnated. This indicates that less impregnation time is required under these conditions.

Series 1 demonstrated less complete impregnation and very uniform impregnation depth. From inspecting the cross sections of series 1, there are two types of impregnated areas: a mauve area around the outer perimeter and a brown area towards the center. There is a transition area between the solid mauve and solid brown regions. If it is assumed that the mauve area is more dense resin, then the conclusion is that lower pressure and more time would allow a thinner but denser impregnation zone.

Example 3

Using the same preparation as in Example 1, three other phenol formaldehyde resin formulations were tested in order to observe any differences during impregnation and curing. Samples from all three previous fiber shape series were used under two impregnation pressure and time conditions. The resin viscosities are listed below along with the impregnation temperature. Table 3 describes the results.

TXIM 387: viscosity 252 cps@ 25 C

TXIM 389: viscosity 148 cps @ 25 C

TXIM 391: viscosity 272 cps @ 25 C

Impregnation temp: 21 C.

TABLE 3

| Resin Code | Sample ID | Pressure (psi) | Time (min) | Initial AD Pulp Weight (g) | Final BD wt (g) | Weight Increase (%) |
|---|---|---|---|---|---|---|
| TXIM 387 | 1E | 15 | 4 | 19.7 | 29.4 | 33 |
| TXIM 389 | 2E | 15 | 4 | 20.3 | 32.0 | 58 |
| TXIM 391 | 3E | 15 | 4 | 21.4 | 32.0 | 50 |

TABLE 3-continued

| Resin Code | Sample ID | Pressure (psi) | Time (min) | Initial AD Pulp Weight (g) | Final BD wt (g) | Weight Increase (%) |
|---|---|---|---|---|---|---|
| TXIM 387 | 1F | 30 | 2 | 24.1 | 35.9 | 49 |
| TXIM 389 | 2F | 30 | 2 | 24.7 | 41.6 | 68 |
| TXIM 391 | 3F | 30 | 2 | 25.6 | 38.6 | 51 |

The results are as follows:

The lower viscosity TXIM 389 impregnated much faster, but the percentage of lower molecular weight material seems to be higher (i.e. larger brown region). This may result in higher weight and less strength.

The improved EBH 04 (TXIM 383) at 30 psi for 2 min. (from Example 1) from a visual comparison, seems to yield the best results in terms of skin formation, and migration of larger molecular weight material into the fiber matrix.

Example 4

A rudimentary comparative strength analysis was made between the wood fiber/PF resin composite and different wood and steel samples. The samples tested were; solid white pine, solid white birch, solid maple, poplar LVL (laminated veneer lumber), and carbon steel. The comparison was made on the basis of the same footprint and equal total weights (i.e. the thickness varied). The footprint was a rectangle of approximately 6 square centimeters. During each test, the clamp was hand tightened until either the maximum force was applied, or a catastrophic failure occurred (the assumption was made that the maximum force remained the same since the same person performed all of the tests). Table 4 describes the outcomes.

TABLE 4

| Sample | Maximum Force Reached (yes/no) | Description of Effect |
|---|---|---|
| White pine | No | Catastrophic failure (CF) |
| White birch | Yes | Deformed and fracture but no CF |
| Maple | Yes | No effect |
| Poplar LVL | Yes | Deformed and fractured by no CF |
| Carbon steel | Yes | Permanently deformed but no CF |
| Fiber/PF composite | Yes | No effect |

The main conclusions were as follows:

The composite material, according to the invention, was stronger, in the sense that no deformation or fracturing occurred, than all of the wood samples except maple.

However, since the comparison could only be made up to the point of maximum force, the difference between the composite and the maple could not be determined.

The composite appeared to be more rigid than the carbon steel, since the same weight of steel did deform. This is significant since the main purpose for the composite is to compete against steels.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated.

The invention claimed is:

1. A method of making a rigid lignocellulose fiber-resin composite structural material, the method consisting essentially of:

(a) providing an aqueous lignocellulose fiber pulp slurry having an effective consistency;

(b) de-watering said slurry by applying a compression pressure to provide a de-watered material at an effective de-watering rate under an effective pressure to prevent or reduce the formation of fissures and voids within said material;

(c) drying an effective amount of said de-watered material at an effective temperature and period of time to provide said formed, dried lignocellulose fiber material of a shape having a thickness of at least 5 mm;

(d) impregnating said dried formed fiber material with a liquid thermoset resin under an effective pressure for an effective period of time to effect impregnation of said resin in said dried formed fiber material at a desired rate and to a desired degree to produce a resin-treated material; and (e) curing said resin in said resin-treated material to produce the composite material.

2. A method according to claim 1, wherein said impregnation step (d) is carried out at a temperature of 5-25° C.

3. A method according to claim 1, further consisting essentially of form-pressing said resin-treated material prior to curing step (e).

4. A method according to claim 3, wherein said form-pressing step consisting essentially of extruding said material or sandwiching said material.

5. A method according to claim 1, wherein said curing step (e) is initially carried out at an effective temperature of below about 100° C.

6. A method according to claim 1, wherein said composite material has a thickness of at least 2 cm while having a greater length and width.

7. A method according to claim 6, wherein said composite material is resistance to deformation.

8. A method according to claim 6, wherein said composite material has a greater strength to weight ratio than steel.

* * * * *